US012550986B2

(12) United States Patent
Wilson et al.

(10) Patent No.: US 12,550,986 B2
(45) Date of Patent: Feb. 17, 2026

(54) FASHION CARRY BAG ASSEMBLY WITH DETACHABLE PURSE

(71) Applicant: Funko, LLC, Everett, WA (US)

(72) Inventors: Laci Marie Wilson, Los Angeles, CA (US); Elisabeth DeSilva, Diamond Bar, CA (US); Monique Herrera, Santa Clarita, CA (US); Domonique Janae Battle, Inglewood, CA (US); Desiree Navarro-Silverman, Los Angeles, CA (US)

(73) Assignee: Funko, LLC, Everett, WA (US)

( * ) Notice: Subject to any disclaimer, the term of this patent is extended or adjusted under 35 U.S.C. 154(b) by 49 days.

(21) Appl. No.: 18/354,638

(22) Filed: Jul. 18, 2023

(65) Prior Publication Data

US 2024/0023681 A1 Jan. 25, 2024

Related U.S. Application Data

(60) Provisional application No. 63/390,630, filed on Jul. 19, 2022.

(51) Int. Cl.

| | |
|---|---|
| ***A45C 1/02*** | (2006.01) |
| ***A45C 3/06*** | (2006.01) |
| ***A45C 13/08*** | (2006.01) |
| ***A45C 13/30*** | (2006.01) |

(52) U.S. Cl.

CPC ..... *A45C 1/024* (2013.01); *A45C 3/06* (2013.01); *A45C 13/08* (2013.01); *A45C 13/30* (2013.01)

(58) Field of Classification Search

CPC ..... A45C 1/024; A45C 3/06; A45C 13/08; A45C 13/30

See application file for complete search history.

(56) References Cited

U.S. PATENT DOCUMENTS

| | | | | |
|---|---|---|---|---|
| 1,581,985 A | | 4/1926 | Sachs | |
| 1,940,900 A | * | 12/1933 | Barnard | A45C 3/02 190/110 |
| 2,428,906 A | | 10/1947 | Cannella | |
| 2,544,493 A | | 3/1951 | Filenbaum | |
| 2,570,851 A | | 10/1951 | Peyser | |
| 2,672,903 A | | 3/1954 | Machinist | |

(Continued)

FOREIGN PATENT DOCUMENTS

| | | |
|---|---|---|
| CN | 214853482 U | 11/2021 |
| FR | 855081 | 5/1940 |

*Primary Examiner* — Tri M Mai

(74) *Attorney, Agent, or Firm* — LaMorte & Associates, P.C.

(57) ABSTRACT

A carry bag assembly that includes a first shoulder bag and a smaller second hand bag. The two bags can be carried separately as a unit. The first shoulder bag has a front surface, a rear surface, a first side surface, and a second side surface. Two bands extend from the shoulder bag that extend beyond the front surface of the shoulder bag. The second hand bag contains a first belt loop and a second belt loop. The belt loops receive the bands that extend from the shoulder bag. Mechanical connectors connecting the first band to the second band around the hand bag. This selectively locks the smaller hand bag into a fixed position against the front surface of the larger shoulder bag. The two bags can share graphics of design themes so that the two bags appear to be a single unit when attached.

6 Claims, 5 Drawing Sheets

(56) References Cited

U.S. PATENT DOCUMENTS

| | | | | | |
|---|---|---|---|---|---|
| 2,801,666 | A | | 8/1957 | Steele | |
| 2,844,179 | A | | 7/1958 | Koret | |
| 3,121,452 | A | | 2/1964 | Hyman | |
| 3,122,225 | A | | 2/1964 | Ward | |
| 3,696,850 | A | | 10/1972 | Rosemblum | |
| D246,484 | S | | 11/1977 | Wasserman | |
| 4,081,061 | A | | 3/1978 | Tucker | |
| 4,096,929 | A | | 6/1978 | Frey et al. | |
| 4,112,991 | A | | 9/1978 | Barbaresi | |
| 4,116,310 | A | | 9/1978 | Shields | |
| 4,122,925 | A | | 10/1978 | Schultheiss | |
| 4,250,938 | A | | 2/1981 | Siegel | |
| 4,257,463 | A | | 3/1981 | Monaco | |
| 4,301,849 | A | * | 11/1981 | Litwack | A45C 13/08 150/117 |
| 5,209,279 | A | * | 5/1993 | Wilson | A45C 7/0086 190/110 |
| 5,402,869 | A | | 4/1995 | Saltzman | |
| 5,431,262 | A | | 7/1995 | Rekuc et al. | |
| 5,713,439 | A | | 2/1998 | Zionts et al. | |
| D420,792 | S | * | 2/2000 | Sakelliou | D3/217 |
| D421,239 | S | * | 2/2000 | Shillingburg | D11/217 |
| 6,502,676 | B2 | | 1/2003 | Dexheimer | |
| 6,619,447 | B1 | | 9/2003 | Garcia | |
| 7,717,440 | B1 | | 5/2010 | Baba | |
| 8,820,596 | B1 | | 9/2014 | Bergquist | |
| D731,788 | S | | 6/2015 | Joo et al. | |
| 2008/0169164 | A1 | * | 7/2008 | Cook | A45C 7/0045 190/124 |
| 2011/0011503 | A1 | | 1/2011 | Parker | |
| 2011/0146856 | A1 | | 6/2011 | Vancelette | |
| 2012/0103481 | A1 | | 5/2012 | Nieves | |
| 2012/0175208 | A1 | * | 7/2012 | Lin | A45C 13/36 190/120 |
| 2013/0175129 | A1 | * | 7/2013 | Rankin | A45C 5/14 190/18 A |
| 2013/0327608 | A1 | | 12/2013 | Murdoch et al. | |
| 2014/0182753 | A1 | | 7/2014 | Secretan | |
| 2015/0101903 | A1 | * | 4/2015 | Schultz | A45C 7/0045 190/18 R |
| 2015/0208776 | A1 | * | 7/2015 | Bennett | A45C 5/146 190/15.1 |
| 2021/0137235 | A1 | * | 5/2021 | Humphrey Felix | A45C 13/30 |

* cited by examiner

FASHION CARRY BAG ASSEMBLY WITH DETACHABLE PURSE

RELATED APPLICATION

This application claims benefit of U.S. Provisional Patent Application No. 63/390,630, filed Jul. 19, 2022.

BACKGROUND OF THE INVENTION

1. Field of the Invention

In general, the present invention relates to the structure of small fashion carry bags, such as shoulder bags, that are often worn in place of carrying a handbag. More particularly, the present invention relates to the structure of the carry bag and to carry bags that have detachable elements.

2. Prior Art Description

Fashionable carry bags come in a wide variety of shapes and styles. One of the most common fashionable carry bags is the shoulder bag. A shoulder bag has a single long strap that passes over a person's shoulder. This positions the shoulder bag at an individual's side generally at hip height.

One consideration in the design of a shoulder bag is practicality. Ideally, a shoulder bag should be able to hold most everyday items, such as a wallet, keys, a phone, and sunglasses. Shoulder bags are typically stylized in order to be fashionable. A small shoulder bag may be more fashionable than a large shoulder bag. As such, shoulder bag designers must balance the size and practicality of a shoulder bag and the aesthetics and/or fashionablity of the shoulder bag.

One way to maintain a small shoulder bag size yet maintain the ability of the shoulder bag to carry many objects, is to place pockets and accessories on the outside of the shoulder bag. In U.S. Pat. No. 2,544,493 to Filenbaum, a shoulder bag is disclosed where a wallet is accessible on the outside of the shoulder bag. The wallet is partially received within a pocket of the shoulder bag and can be separated from the shoulder bag at the discretion of the user.

In U.S. Pat. No. 3,696,850 to Rosenblum, a shoulder bag is shown where a separate secondary bag is attached to the outside of the shoulder bag using hooks. The secondary bag can be selectively separated from the shoulder bag. However, there is nothing to prevent the secondary bag from inadvertently separating from the shoulder bag should the overall bag assembly be dropped or bumped. Furthermore, a small wallet size bag hooked onto a shoulder bag is a tempting target to a would-be pickpocket or thief.

Additionally, when a smaller secondary bag is attached to the exterior of a larger primary bag, it is very difficult for the full bag assembly to be fashionable. As such, it is difficult to make two bag assemblies stylish and fashionable.

A need therefore exists for a two bag assembly that contains both a large primary bag and a smaller secondary bag, where the smaller bag can be firmly secured to the larger bag, yet still be quickly removable. A need further exists for a two bag system where the smaller bag and the larger bag share a fashion theme in a manner that the two bags aesthetically complement each other when attached. These needs are met by the present invention as described and claimed below.

SUMMARY OF THE INVENTION

The present invention is a carry bag assembly that includes a first shoulder bag and a smaller second hand bag.

The two bags can be carried separately or can be interconnected to be carried as a unit. The first shoulder bag has a front surface, a rear surface, a first side surface, and a second side surface. Two bands extend from the shoulder bag. A first band extends from the first side surface. A second band extends from the second side surface. Both bands extend beyond the front surface of the shoulder bag.

The second hand bag contains a first belt loop and a second belt loop. The belt loops are positioned and sized to receive the bands that extend from the shoulder bag. The first band extends through the first belt loop and the second band extends through the second belt loop.

Mechanical connectors are attached to the bands near the free ends of the bands. The mechanical connectors can be used to selectively connect the first band to the second band around the hand bag. This selectively locks the smaller hand bag into a fixed position against the front surface of the larger shoulder bag. The two bags can share graphics of design themes so that the two bags appear to be a single unit when attached.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention fashion carry bag assembly can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
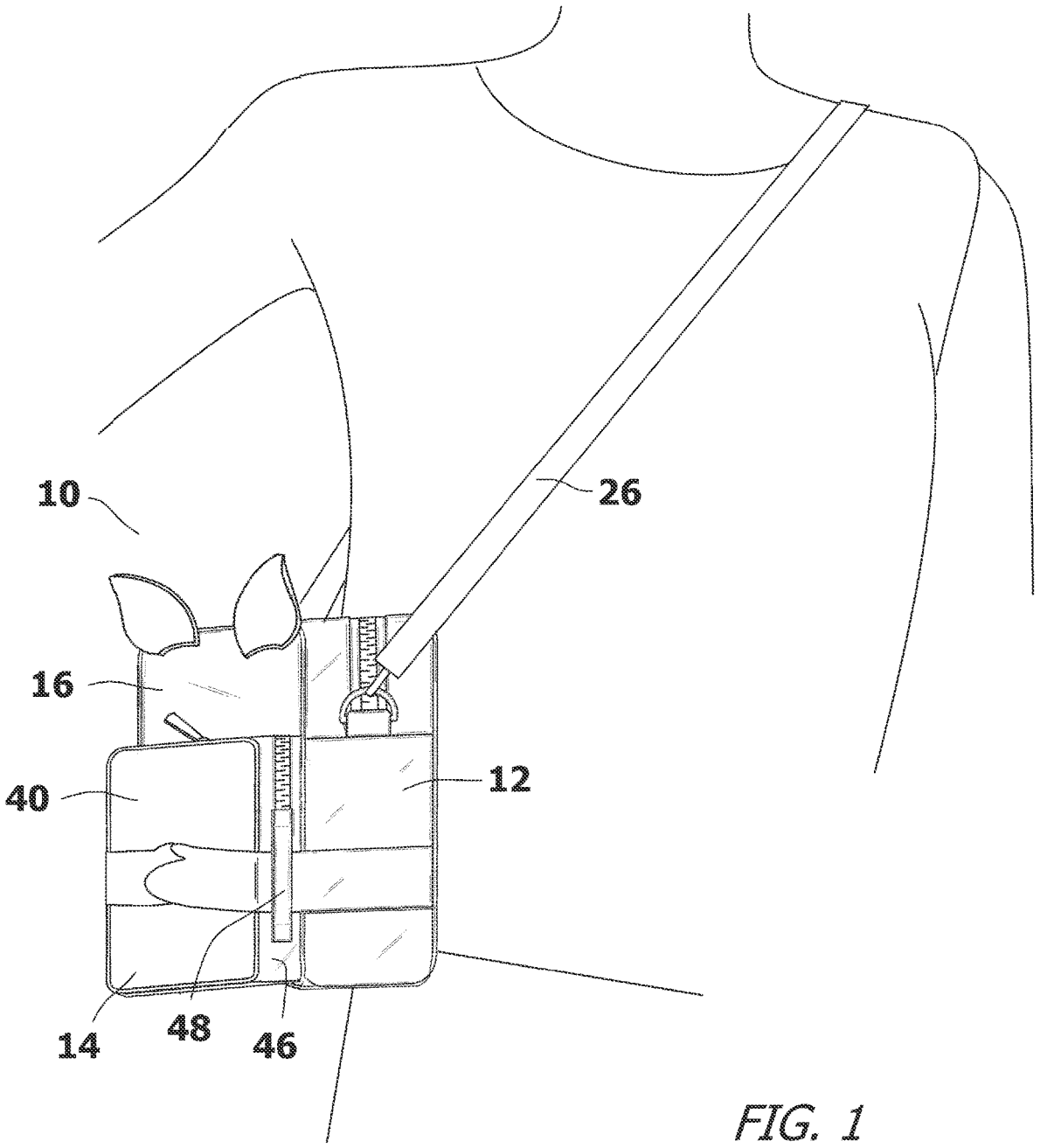
FIG. 1 shows an exemplary embodiment of a fashion carry bag assembly that contains both a shoulder bag and a hand bag being carried as a unit by a standing individual.
Figure 2:
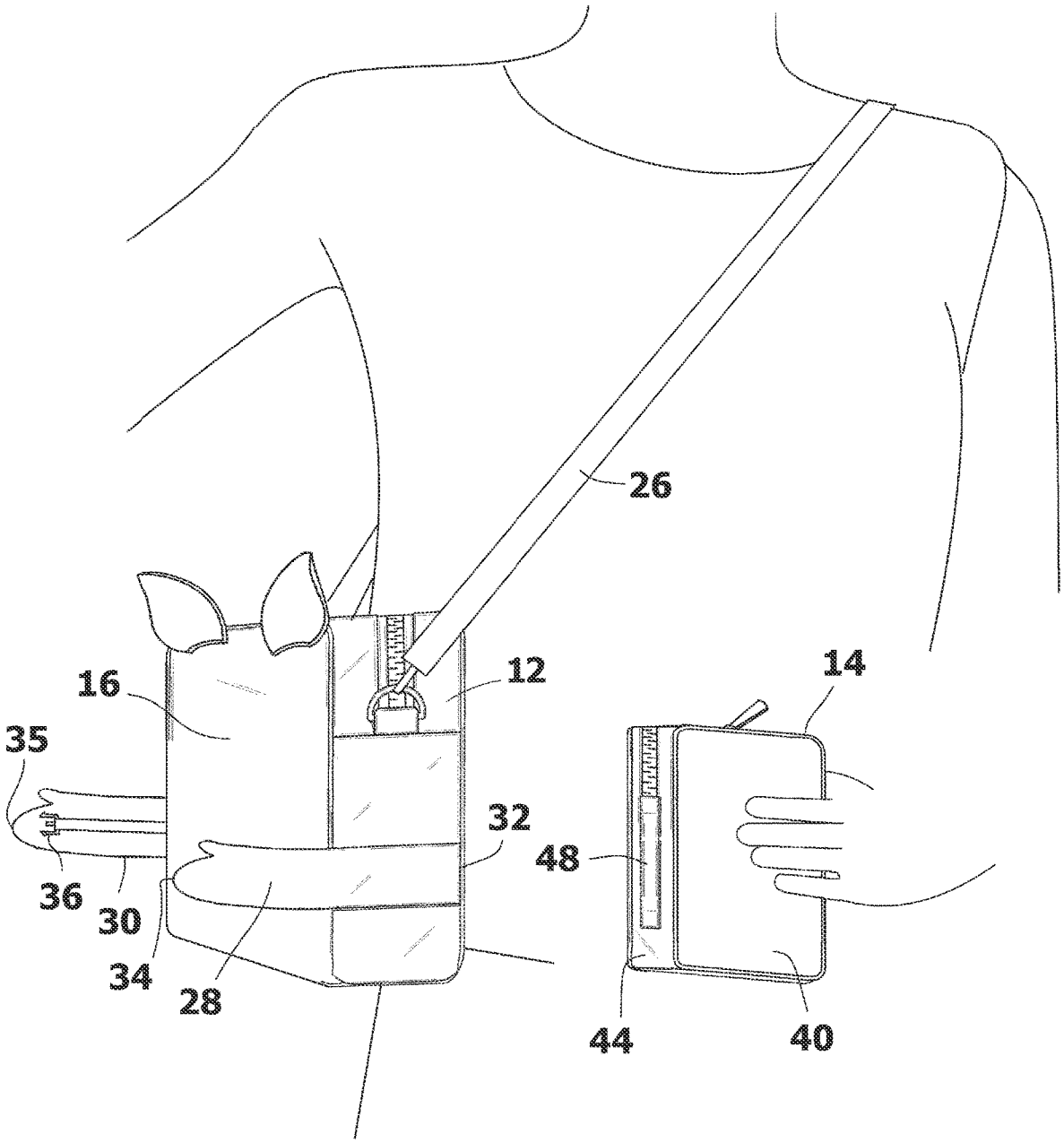
FIG. 2 shows the exemplary embodiment of FIG. 1 with the shoulder bag and a hand bag being carried separately by a standing individual.

Referring together to FIG. 1 and FIG. 2, a fashion carry bag assembly 10 is shown. The fashion carry bag assembly 10 has a compound construction and includes both a shoulder bag 12 and a hand bag 14. The hand bag 14 is selectively attachable to, and detachable from, the shoulder bag 12. Accordingly, the full fashion carry bag assembly 10 can be worn together, as is shown in FIG. 1. Alternatively, the shoulder bag 12 can be worn apart from the hand bag 14 and the hand bag 14 can be carried apart from the shoulder bag 12, as is shown in FIG. 2.

Figure 3:
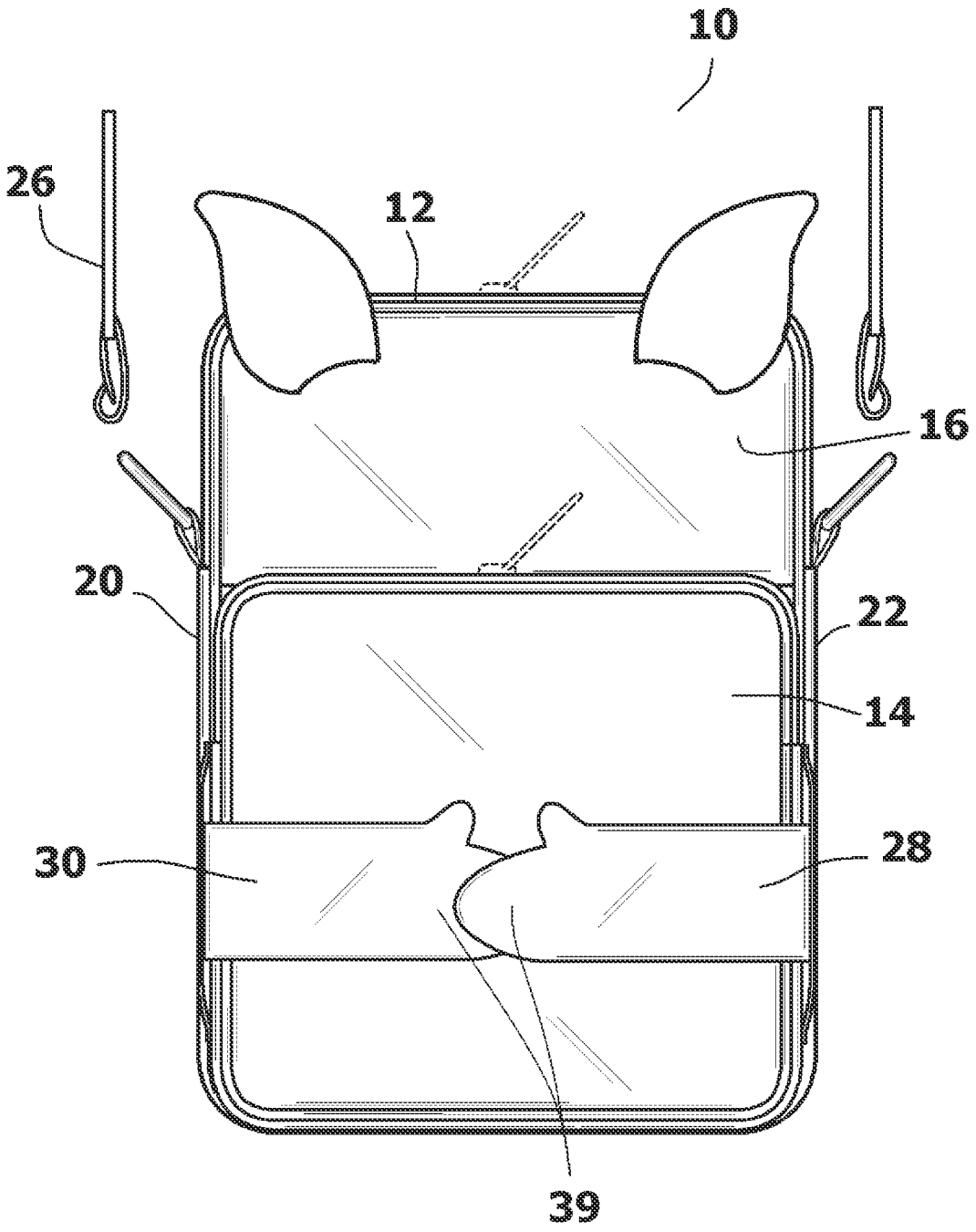
FIG. 3 shows a front view of the fashion carry bag assembly in an assembled condition.
Figure 4:
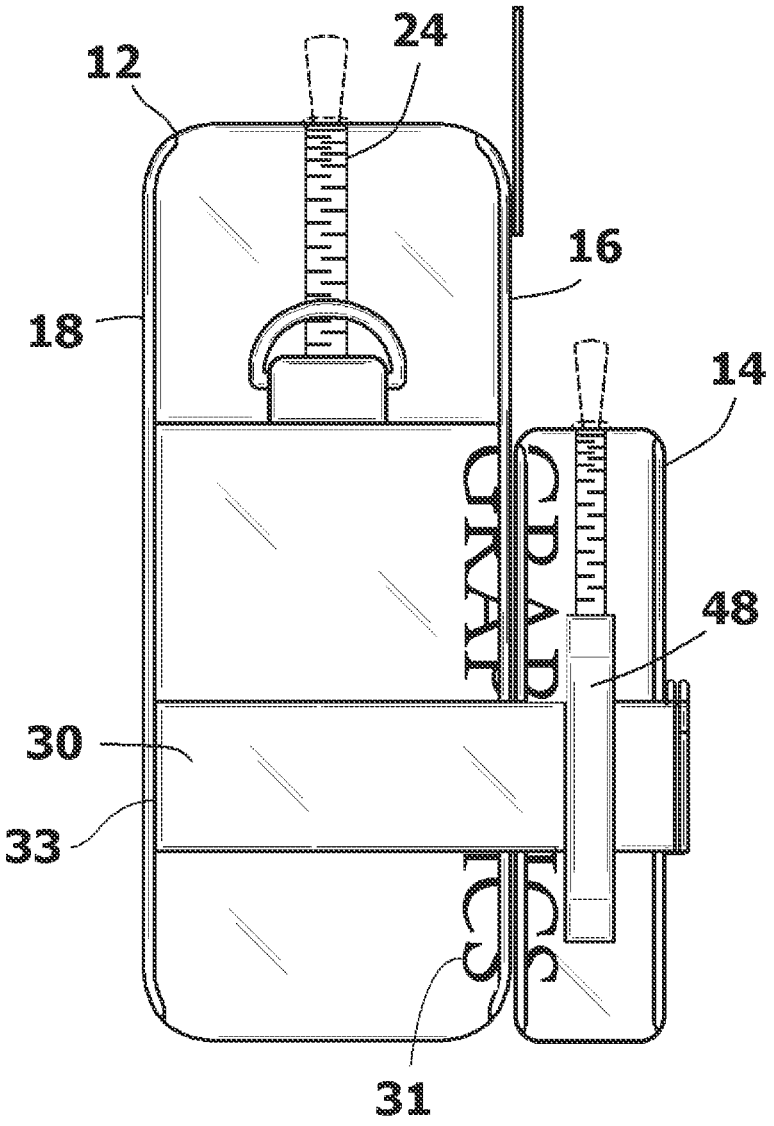
FIG. 4 shows a side view of the exemplary embodiment of FIG. 3.

Referring to FIG. 3 and FIG. 4 in conjunction with FIG. 1 and FIG. 2, it can be seen that the shoulder bag 12 has a front surface 16, a rear surface 18 and side surfaces 20, 22 that extend between the front surface 16 and the rear surface 18. The shoulder bag 12 defines at least one interior pocket that is accessible through a reclosable opening, such as a zippered access opening 24. One or more straps 26 are attached to the shoulder bag 12 that enable the shoulder bag 12 to be worn on the shoulder.

When the shoulder bag 12 is worn, the rear surface 18 of the shoulder bag 12 faces the wearer. The front surface 16 of the shoulder bag 12 faces away from the wearer. Two bands 28, 30 extend from the side surfaces 20, 22 of the shoulder bag 12. The bands 28, 30 have anchored ends 32, 33 that are sewn or otherwise fastened to the shoulder bag 12. The bands 28, 30 also have free ends 34, 35 that extend away from the shoulder bag 12. A mechanical connector 36 is provided that has two sections that selectively connect and disconnect. The free ends 34, 35 of the bands 28, 30 each respectfully terminate with an opposite section of the mechanical connector 36. The mechanical connector 36 enables the free ends 34, 35 of the bands 28, 30 to mechanically join together slightly beyond the front surface 16 of the shoulder bag 12. The bands 28, 30 can be shaped to conform to the fashion theme of the overall assembly 10. For example, if the overall fashion assembly 10 has a character theme, such as is illustrated, then the bands 28, 30 can be configured as arms or legs. In the illustrated embodiment, the bands 28, 30 are configured as arms. Accordingly, they are terminated with hand structures 39 above the two sections of the mechanical connectors 36.

Figure 5:
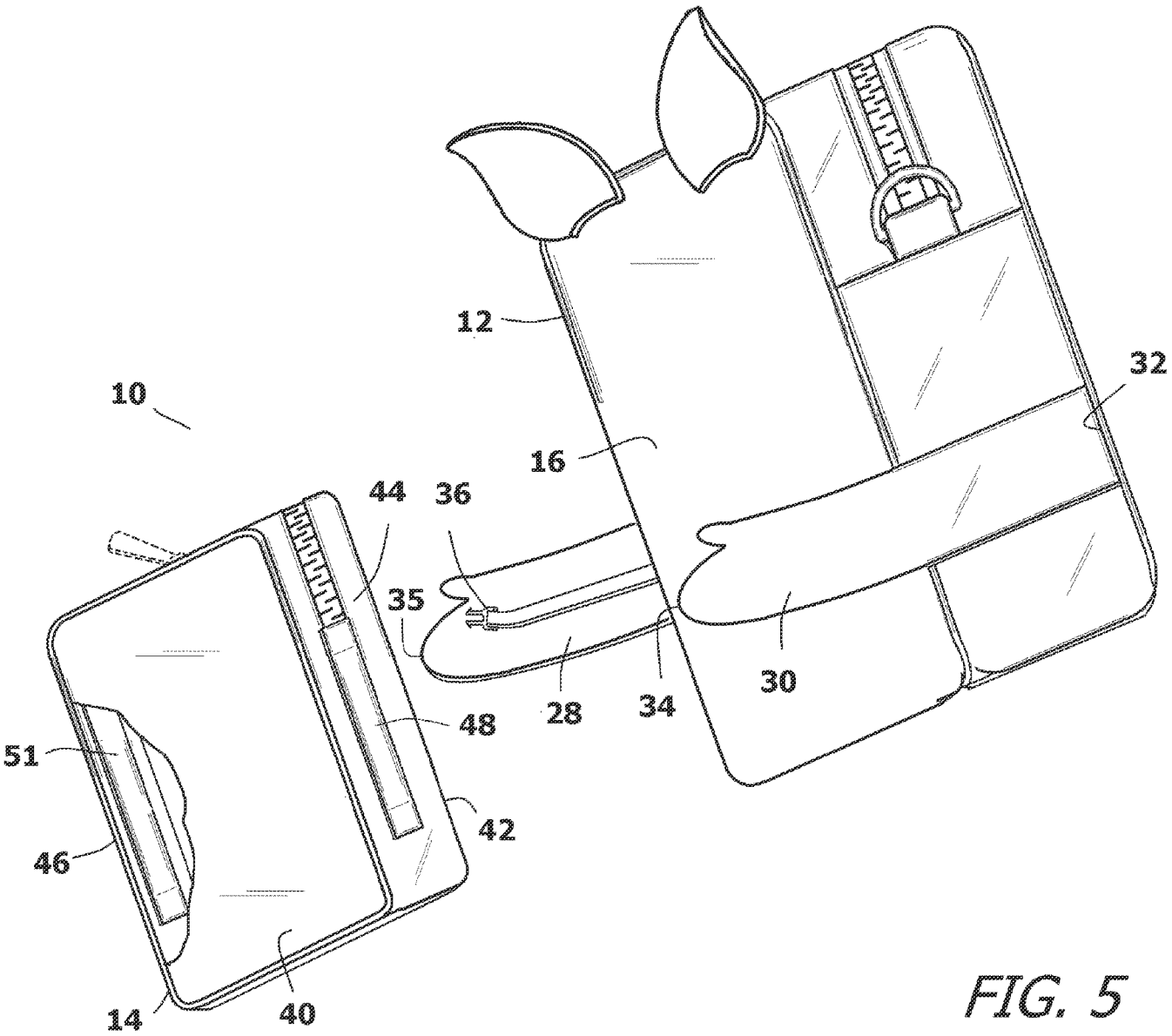
FIG. 5 shows an exploded perspective view of the exemplary embodiment of FIG. 3 and FIG. 4.

As seen in FIG. 5, the hand bag 14 shares the same fashion theme as does the shoulder bag 12. The hand bag 14 is shorter and thinner than the shoulder bag 12. The hand bag 14 has a front surface 40, a back surface 42, and two side surfaces 44, 46. Belt loops 48 are provided on the side surfaces 44, 46 of the hand bag 14. The belt loops 48 are sized to enable the bands 28, 30 from the shoulder bag 12 to pass therethrough.

Referring to FIG. 5 in conjunction with FIG. 4 and FIG. 3, it can be seen that the handbag 14 is separate and distinct from the shoulder bag 12. However, the back surface 42 of the hand bag 14 can be positioned against the front surface 16 of the shoulder bag 12. In this position, the bands 28, 30 on the shoulder bag 12 can be selectively advanced through the belt loops 48 on the hand bag 14. Once advanced through the belt loops 48, the two sections of the mechanical connector 36 on the bands 28, 30 can be interconnected around the hand bag 14. This locks the hand bag 14 into position on the front surface 16 of the shoulder bag 12.

Since the shoulder bag 12, the bands 28, 30, and the hand bag 14 all share the same fashion theme, the combination of the hand bag 14 on the front of the shoulder bag 12 produces a fashion carry bag assembly that has the appearance of being a single piece carry bag. The side surfaces of both the shoulder bag 12 and the hand bag 14 can share the same graphics 31 so that they appear to be part of a unistructural carry bag when assembled. In addition, the hand bag 14 may have different designs on the front surface 40 and back surface 42 so that the hand bag 14 can be turned around or reversed to change the outward look of the fashion assembly 10. In addition, a carry bag assembly system may include one or more shoulder bags 12, each associated with one or more hand bags 14 with related graphics 31 so that the user may mix and match the shoulder bags 12 and the hand bags 14 to achieve a desired appearance.

It should further be understood that the hand bag 14 can be manufactured to be invertible. In this manner, the color scheme and/or theme of the hand bag 14 can be selectively changed by inverting the hand bag 14. A second set of belt loops 51 can be provided in the hand bag 14. The second set of belt loops 51 become exposed when the hand bag 14 is inverted. In this manner, the inverted purse 14 can attach to the shoulder bag 12 both when in the standard configuration and when inverted in the same manner as has previously been explained.

When the hand bag 14 is attached to the shoulder bag 12, the hand bag 14 is locked in place by the passage of the bands 28, 30 extending through the belt loops 48. The bands 28, 30 lock together using the mechanical connector 36. Accordingly, the hand bag 14 cannot be disconnected from the shoulder bag 12 unless the mechanical connector 36 is opened and the bands 28, are withdrawn through the belt loops 48. Such a disconnection cannot be achieved accidently or without the knowledge of the person holding the fashion carry bag assembly 10.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A carry bag assembly, comprising:

a shoulder bag having a front surface, a first side surface, and a second side surface, wherein said shoulder bag has a character theme that includes a first arm and a second arm that extend from said shoulder bag;

a first band having a first anchored end and a first free end, wherein said first anchored end is sewn to said first side surface of said shoulder bag and said first free end extends from said first side surface beyond said front surface, therein forming said first arm;

a second band having a second anchored end and a second free end, wherein said second anchored end is sewn to said second side surface of said shoulder bag and said second free end extends from said second side surface beyond said front surface, therein forming said second arm;

a hand bag that is smaller than said shoulder bag, said hand bag having a forward surface, a rearward surface a first side and a second side, wherein a first belt loop is attached to said first side and a second belt loop is attached to said second side, wherein said first band extends through said first belt loop and said second band extends through said second belt loop; and a connector for selectively connecting said first band to said second band around said hand bag, therein selectively locking said rear surface of said hand bag into a fixed position against said front surface of said shoulder bag.

2. The assembly according to claim 1, wherein said shoulder bag has a first height and said hand bag has a second height that is shorter than said first height.

3. The assembly according to claim 1, wherein said first side surface of said shoulder bag, said second side surface of said shoulder bag, said first side of said hand bag, and said second side of said hand bag all share common graphics.

4. The assembly according to claim 1, wherein said first band and said second band both terminate with hand structures.

5. The assembly according to claim 1, wherein said hand bag is invertible into an inverted hand bag contains an alternate set of belt loops, wherein said first band and said second band extend through said alternate set of belt loops to join said inverted hand bag to said shoulder bag.

6. The assembly according to claim 1, wherein said hand bag can be reversed and attached to said shoulder bag, wherein said second band extends through said first belt loop and said first band extends through said second belt loop.

* * * * *